US007347274B2

(12) United States Patent
Patel et al.

(10) Patent No.: US 7,347,274 B2
(45) Date of Patent: Mar. 25, 2008

(54) ANNULAR BARRIER TOOL

(75) Inventors: Dinesh R. Patel, Sugar Land, TX (US); Jose F. Garcia, Sugar Land, TX (US); Philippe Gambier, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 297 days.

(21) Appl. No.: 10/905,848

(22) Filed: Jan. 24, 2005

(65) Prior Publication Data

US 2005/0161232 A1 Jul. 28, 2005

Related U.S. Application Data

(60) Provisional application No. 60/539,398, filed on Jan. 27, 2004.

(51) Int. Cl.
*E21B 33/12* (2006.01)

(52) U.S. Cl. ..... 166/386; 166/120; 166/122

(58) Field of Classification Search ..... 166/125, 166/126, 118, 119, 140, 185, 230
See application file for complete search history.

(56) References Cited

U.S. PATENT DOCUMENTS

| | | | | |
|---|---|---|---|---|
| RE7,244 | E | 7/1876 | Martin | |
| 2,216,268 | A | 10/1940 | Fritsche | 73/155 |
| 2,945,541 | A | 7/1960 | Maly et al. | 166/187 |
| 3,070,167 | A | 12/1962 | Loy, III et al. | 166/153 |
| 3,374,838 | A | 3/1968 | Current | 166/123 |
| 3,797,864 | A | 3/1974 | Hynes et al. | |
| 3,918,523 | A | 11/1975 | Stuber | 166/285 |
| 3,948,322 | A * | 4/1976 | Baker | 166/289 |
| 4,127,168 | A | 11/1978 | Hanson et al. | |
| 4,403,660 | A | 9/1983 | Coone | 166/387 |
| 4,406,461 | A * | 9/1983 | McGill | 277/334 |
| 4,424,865 | A | 1/1984 | Payton, Jr. | 166/302 |
| 4,515,213 | A | 5/1985 | Rogen et al. | 166/123 |
| 4,583,746 | A | 4/1986 | Lawson | |
| 5,195,583 | A | 3/1993 | Toon et al. | 166/187 |
| 5,236,201 | A | 8/1993 | Vance, Sr. et al. | 277/34.6 |
| 5,297,633 | A | 3/1994 | Snider et al. | 166/387 |
| 5,685,369 | A | 11/1997 | Ellis et al. | |
| 5,904,354 | A | 5/1999 | Collins | 277/328 |
| 5,941,313 | A | 8/1999 | Arizmendi | 166/387 |
| 6,123,148 | A | 9/2000 | Oneal | 166/118 |
| 6,325,144 | B1 * | 12/2001 | Turley et al. | 166/120 |

(Continued)

FOREIGN PATENT DOCUMENTS

EP 0 428 422 B1 1/1998

(Continued)

OTHER PUBLICATIONS

U.S. Appl. No. 10/763,565, entitled, "Well Packer Having An Energized Sealing Element and Associated Method," filed Jan. 23, 2004.

*Primary Examiner*—Frank Tsay
(74) *Attorney, Agent, or Firm*—Trop, Pruner & Hu, P.C.; Bryan P. Galloway; Tim Curington

(57) ABSTRACT

The present invention provides for an annular barrier tool to block or restrict the flow of well fluids in the annular region of a well.

31 Claims, 6 Drawing Sheets

U.S. PATENT DOCUMENTS

| | | | | |
|---|---|---|---|---|
| 6,446,717 | B1 | 9/2002 | White et al. | |
| 6,513,600 | B2 | 2/2003 | Ross | |
| 6,752,205 | B2 * | 6/2004 | Kutac et al. | 166/187 |
| 6,779,601 | B2 * | 8/2004 | Wilson et al. | 166/187 |
| 6,915,858 | B2 * | 7/2005 | Dolyniuk et al. | 166/387 |
| 2002/0157831 | A1 | 10/2002 | Kurlenya et al. | 166/302 |
| 2002/0166672 | A1 | 11/2002 | White et al. | |
| 2002/0189696 | A1 | 12/2002 | Simpson et al. | 138/89 |
| 2002/0195244 | A1 | 12/2002 | Coronado et al. | 166/196 |
| 2003/0047880 | A1 | 3/2003 | Ross | 277/626 |
| 2003/0062170 | A1 | 4/2003 | Slack | 166/377 |
| 2003/0217844 | A1 | 11/2003 | Moyes | |
| 2004/0032088 | A1 | 2/2004 | Janoff et al. | |
| 2004/0069504 | A1 | 4/2004 | Krueger et al. | 166/387 |
| 2005/0000692 | A1 | 1/2005 | Cook et al. | 166/300 |
| 2005/0056429 | A1 | 3/2005 | Du et al. | 166/311 |
| 2006/0113088 | A1 | 6/2006 | Richard et al. | 166/384 |

FOREIGN PATENT DOCUMENTS

| | | |
|---|---|---|
| GB | 2 371 064 | 7/2002 |
| GB | 2 372 526 | 8/2002 |
| GB | 2 398 313 | 8/2004 |
| GB | 2 399 367 | 9/2004 |
| WO | WO 02/20941 | 3/2002 |
| WO | WO 02/077411 | 10/2002 |

* cited by examiner

ANNULAR BARRIER TOOL

This application claims the benefit of U.S. Provisional Application 60/539,398 filed on Jan. 27, 2004.

BACKGROUND

1. Field of Invention

The present invention pertains to downhole completion devices, and particularly to a downhole completion device in which a barrier to annular flow is established.

2. Related Art

It is often desirable to run a completion device such as a packer, for example, to block or restrict fluid flow through an annular region in a well. The annular region at issue is the space between the wellbore wall and a downhole tool such as production tubing or a completion assembly. Providing an annular barrier to block annular flow allows, for example, zones to be isolated.

SUMMARY

The present invention provides for an annular barrier tool to block or restrict the flow of well fluids in the annular region of a well.

Advantages and other features of the invention will become apparent from the following description, drawings, and claims.

DETAILED DESCRIPTION

Figure 1:
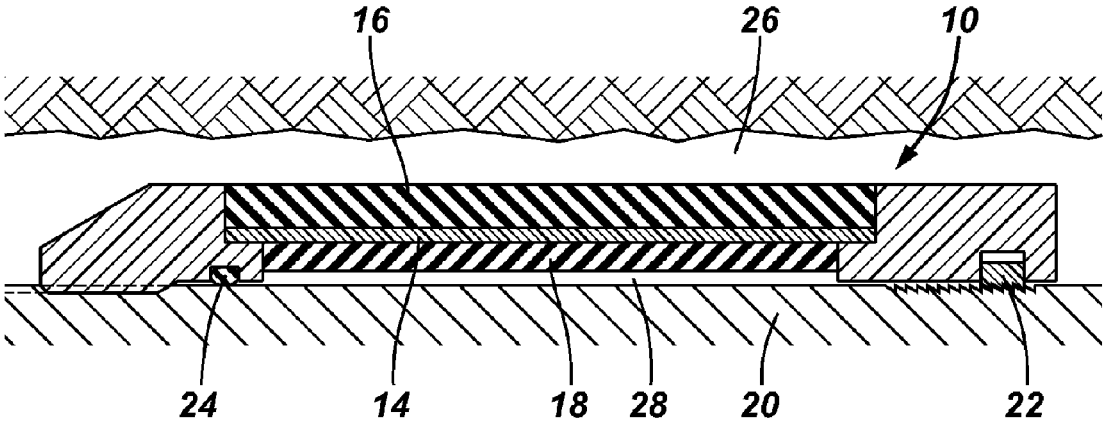
FIG. 1 shows a schematic view of a seal element used in an annular barrier tool constructed in accordance with the present invention.

Referring to FIG. 1, a seal element 10 used in an annular barrier tool 12 (hereinafter, ABT 12) (see FIGS. 5A, 5B, 6A, and 6B) comprises a support 14 disposed between an outer conformable layer 16 and an inner conformable layer 18. Conformable layers 16, 18 may be, for example, made of rubber, metal, thermoplastic, or an elastomeric material.

Seal element 10 uses support 14 to provide structural support to conformable layers 16, 18 of ABT 12.

Seal element 10 is carried on a mandrel 20 of ABT 12. A ratchet 22 is mounted on mandrel 20 near an end of seal element 10. Seal element 10 has mating teeth to engage ratchet 22, preventing relative motion between that end of seal element 10 and mandrel 20 in one direction. A mandrel seal 24 is carried on mandrel 20 and forms a barrier to fluid flow between mandrel 20 and seal element 10 at the end where mandrel seal 24 is located. Fluid communication exists, however, between an annulus 26 and a chamber 28 behind inner conformable layer 18. FIG. 1 shows seal element 10 in a relaxed or unenergized state.

Figure 2:
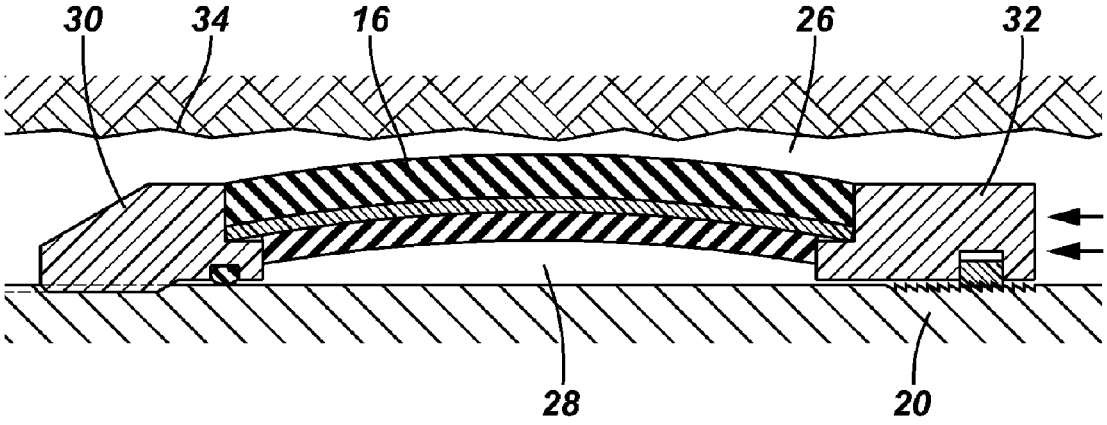
FIG. 2 shows a schematic view of the seal element of FIG. 1 in a first compressed state.

Conformable layers 16, 18 and support 14 are held between end stops 30, 32 (FIG. 2). Outer conformable layer 16 is protected against abrasive damage by end stops 30, 32. One end stop (say, 30) is fixed to mandrel 20, while the opposite end stop (32), on which the mating teeth to ratchet 22 are located, is moveably mounted to mandrel 20. Moveable end stop 32 acts as a piston when a force is applied to it. The roles of end stops 30, 32 may be interchanged.

Figure 3:
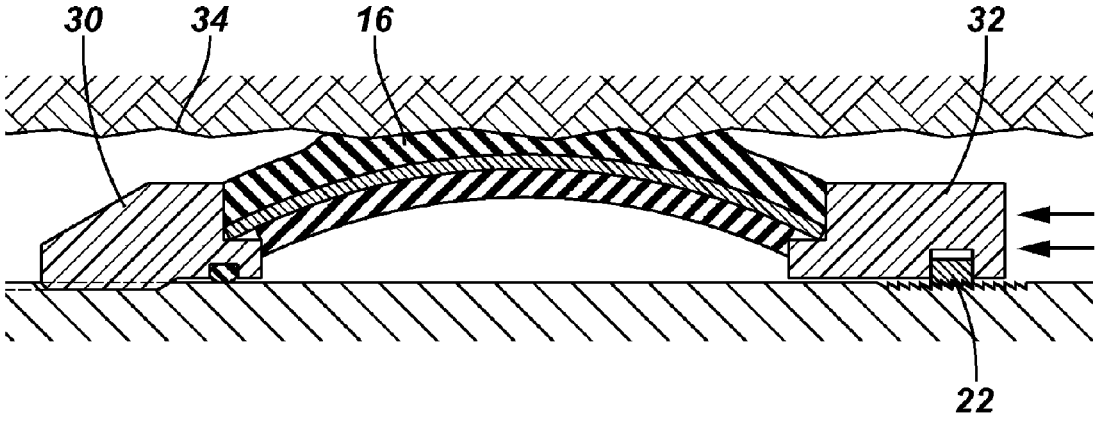
FIG. 3 shows a schematic view of the seal element of FIG. 1 in a second compressed state.

When pressure is applied to end stop 32, support 14 is compressed against fixed end stop 30, causing support 14 to deflect outward toward and ultimately against a wellbore wall 34 (FIG. 3). A setting force may also be applied to end stop 32 using mechanical or chemical means. While FIG. 3 shows the wellbore to be an open hole, ABT 12 may be used in cased holes as well. Support 14 is compressed and elastically deformed. Ratchet 22 maintains compression energy in support 14 even if the pressure on end stop 32 is removed.

Figure 4:
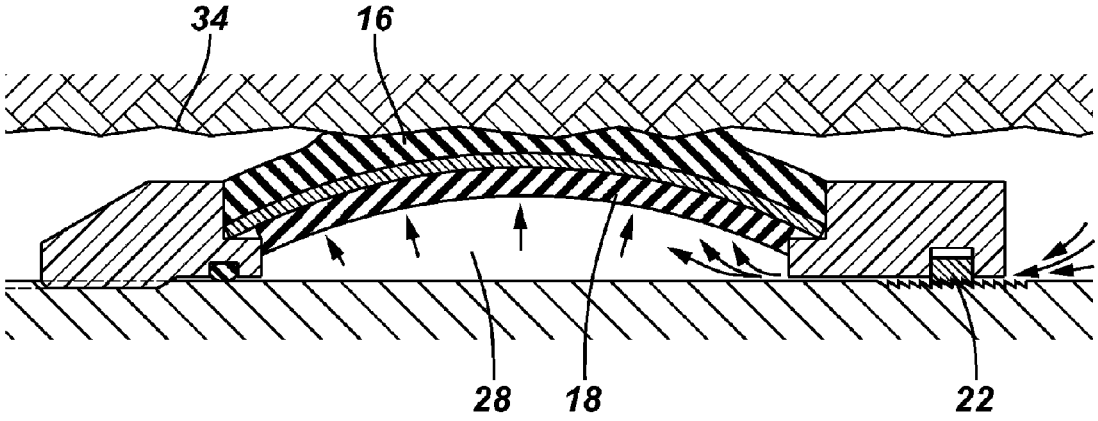
FIG. 4 shows a schematic view of the seal element of FIG. 1 in a third compressed state.

When support 14 is deformed sufficiently outward, outer conformable layer 16 surrounding support 14 contacts wellbore wall 34 and creates a seal between wellbore and outer conformable layer 16. To further increase the sealing capacity, ABT 12 uses, for example, hydrostatic pressure from a high pressure zone to further increase the pressure applied by ABT 12 against wellbore wall 34 (FIG. 4). Injection pressure may also be used. The seal elements 10 may be configured to be used on the up-hole side, the down-hole side, or both, simply by proper arrangement of seal elements 10. In principle, seal element 10 works similarly to C-cup type seals.

The high pressure fluid penetrates beneath inner conformable layer 18 into chamber 28 and pressures up the interior of seal element 10. This can be achieved, for example, by a leak path past ratchet 22 or through a port through end stop 32. The pressure further pushes outer conformable layer 16 against wellbore wall 34, thus increasing the sealing with wellbore wall 34. The elastic deformation of support 14 helps maintain the seal with wall 34 even with the slight variations that may occur because of, for example, changes in pressure, bore shape, and tool movement.

Figure 5A:
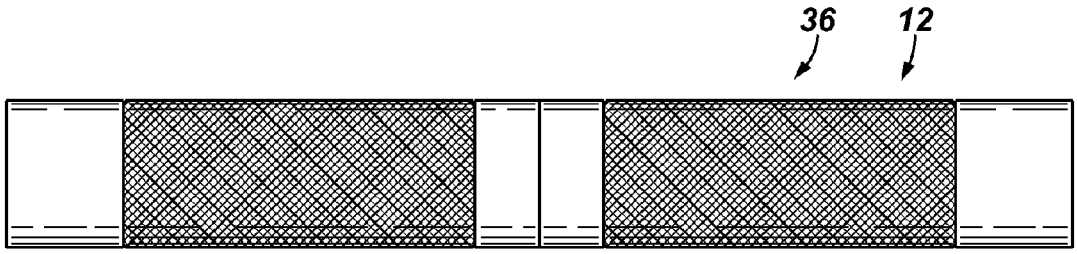
FIGS. 5A and 5B show external and internal schematic views, respectively, of an annular barrier tool constructed in accordance with the present invention.
Figure 5B:
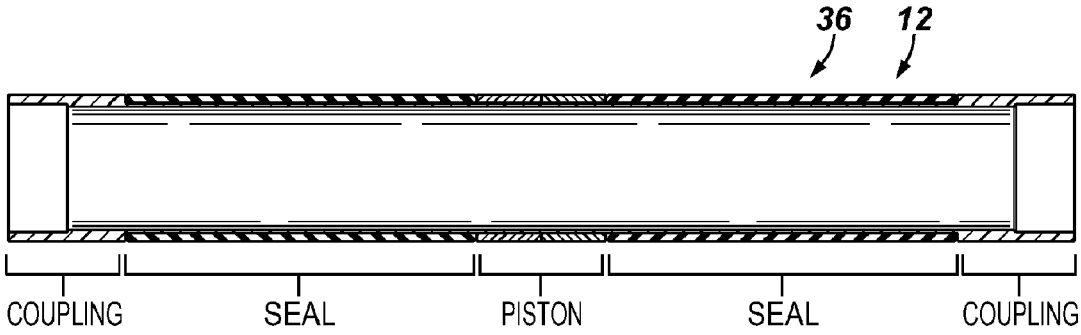
Figure 6A:
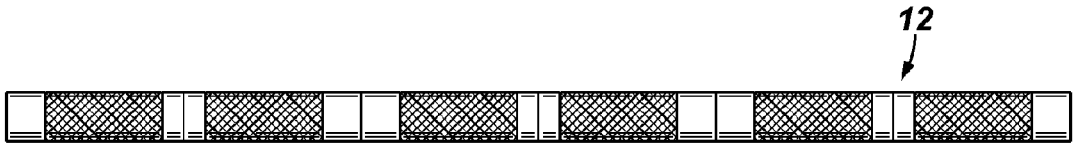
FIGS. 6A and 6B show external and internal schematic views, respectively, of multiple annular barrier tools constructed in accordance with the present invention.
Figure 6B:
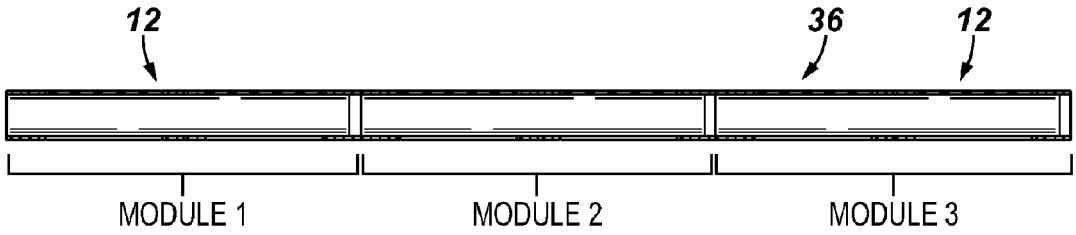

Seal element 10 may be stacked with other seal elements 10 to form a module 36 (FIGS. 5A and 5B). Multiple modules 36, such as the three shown in FIGS. 6A and 6B, may be stacked to create an embodiment of ABT 12.

Figure 7:
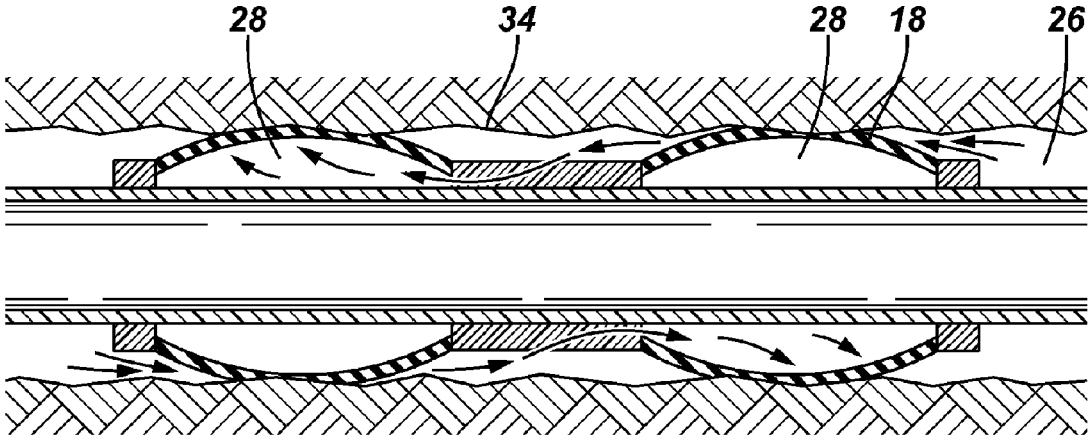
FIG. 7 shows a schematic view of a first seal arrangement for the annular barrier tool of FIG. 5.

The independent seal elements 10 may be arranged within modules 36 to control how the high pressure is allowed to get inside the "dome" of chamber 28. There are at least three possible seal arrangements: (1) facing each other (FIG. 7); (2) opposite each other (FIG. 8); and (3) both facing the same side (FIG. 9).

In the embodiment of FIG. 7, high pressure fluid below the lower seal element 10 slips past that seal element and enters chamber 28 of the upper seal element 10. Similarly, high pressure fluid above the upper seal element 10 slips past that seal element and enters chamber 28 of the lower seal element 10.

Figure 8:
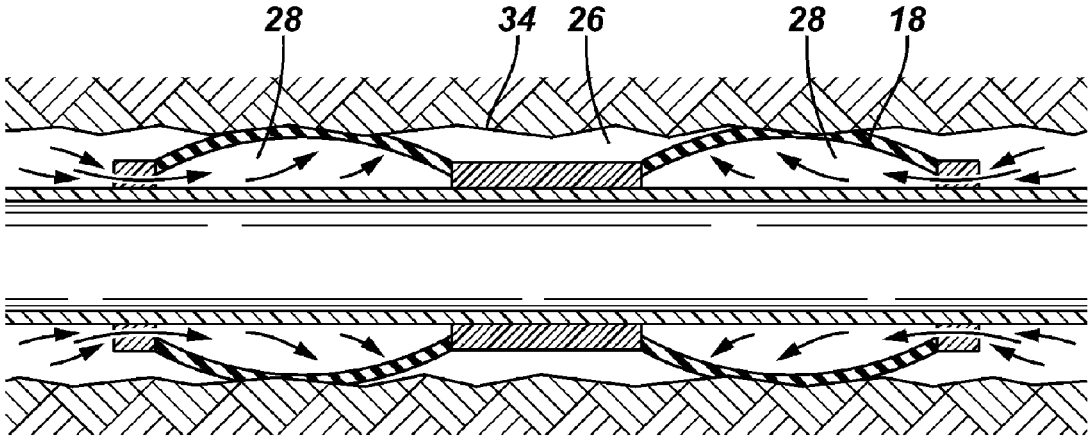
FIG. 8 shows a schematic view of a second seal arrangement for the annular barrier tool of FIG. 5.

In the embodiment of FIG. 8, high pressure fluid below the lower seal element 10 enters chamber 28 of the lower seal element 10. Similarly, high pressure fluid above the upper seal element 10 enters chamber 28 of the upper seal element 10.

Figure 9:
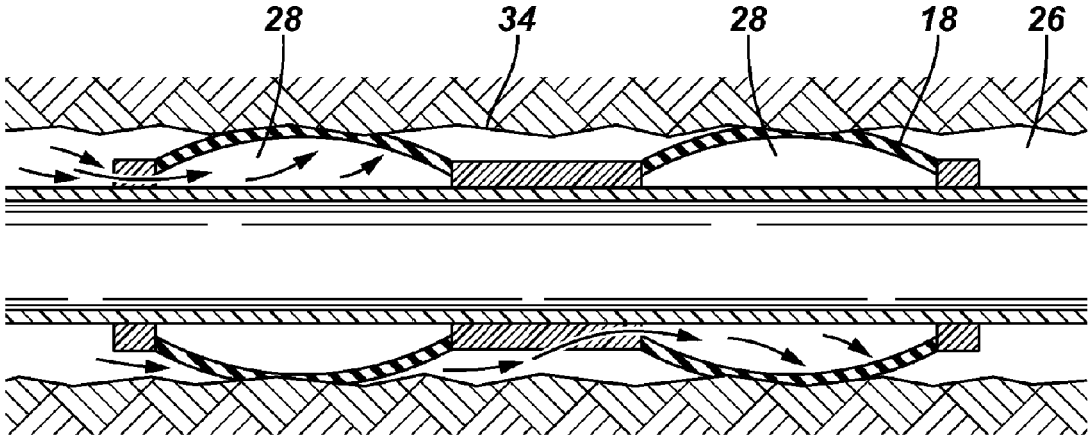
FIG. 9 shows a schematic view of a third seal arrangement for the annular barrier tool of FIG. 5.

In the embodiment of FIG. 9, high pressure fluid above the upper seal element 10 enters chamber 28 of the upper seal element 10. If any high pressure fluid leaks past the upper seal element 10, it enters chamber 28 of the lower seal element 10. In all three embodiments, there is no fluid communication between the annular regions above and below ABT 12.

ABT 12 may be activated in numerous ways such as activation through tubing pressure, control line activation, shunt tube activation, and mechanical activation. For example, a profile may be placed in end stop 32 so that a latching tool run on an intervention device such as slickline, wireline, or coiled tubing can be releasably affixed to end stop 32. Pulling on the intervention device will move end stop 32, forcing seal element 10 to set. Alternatively, pressurized fluid can be transported via the tubing, a shunt tube, or a control line to the entry port of chamber 28, pressurizing chamber 28 and setting seal element 10. In some instances it may be possible to combine two or more of the activation mechanisms, with the aim of building in redundancy or remedial functionalities.

Figure 10A:
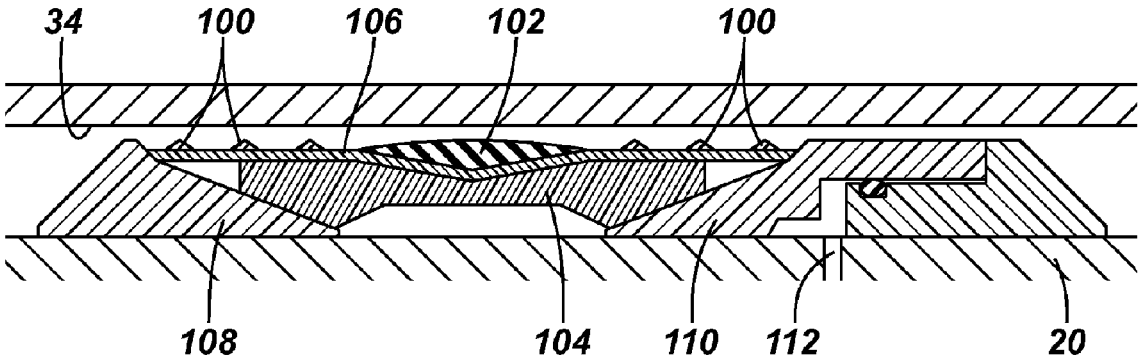
FIGS. 10A and 10B show schematic views of an alternate embodiment of an annular barrier tool constructed in accordance with the present invention.
Figure 10B:
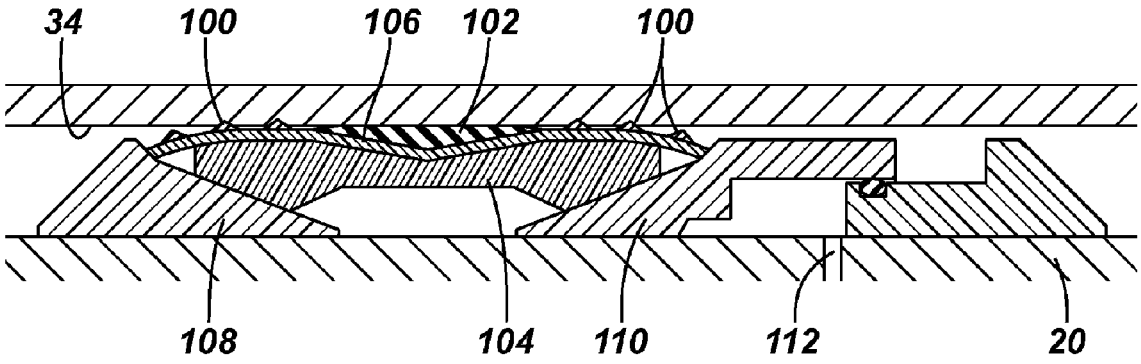

An alternate embodiment of ABT 12 (FIGS. 10A and 10B) has slips 100 and a seal 102 incorporated into a single unit. In the embodiment shown, slips 100 are arranged over a barrel support 104 as an integral part of a support sleeve 106. Slips may also be attached by being welded, for example, directly to support sleeve 106. Support sleeve 106 is preferably made of metal and is attached and sealed on both ends to upper and lower cones 108, 110. Seal 102 is mounted along a portion of the outer surface of support sleeve 106, preferably in its central region, and slips 100 are located on opposite sides of seal 102. Seal 102 is preferably made of rubber, thermoplastic, or an elastomer. When ABT 12 is actuated, seal 102 seals against wellbore wall 34 (or casing, if present) and slips 100 anchor ABT 12 in place in wellbore wall 34 (or casing, if present), as shown in FIG. 10B.

One cone, say upper cone 108, may be fixed to mandrel 20 of ABT 12, while lower cone 110 acts as a moveable piston to press against the lower end of barrel support 104. Lower cone 110 may move, for example, in response to applied pressure or a mechanical force. Fluid pressure may be applied via a port 112. As described above, a ratchet mounted to mandrel 20 mates with complementary teeth on lower cone 110 to prevent movement of lower cone 110 in a particular direction. When lower cone 110 is displaced to actuate ABT 12, it pushes barrel support 104 outward toward wellbore wall 34. In response to the outward push of barrel support 104, support sleeve 106 deforms elastically, forcing seal 102 and slips 100 to engage wellbore wall 34. The roles of upper and lower cones 108, 110 may be interchanged, or both cones 108, 110 may be moveably mounted to mandrel 20. ABT 12 may also be configured to be releasable to allow ABT 12 to be retrieved.

Figure 11A:
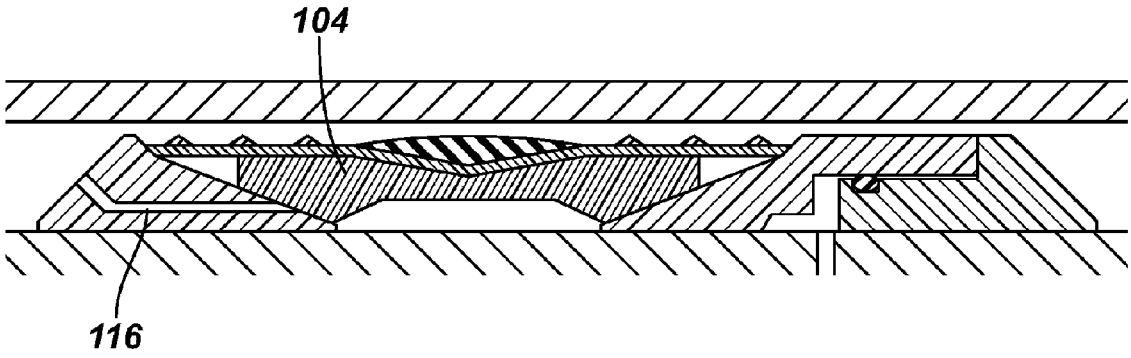
FIGS. 11A and 11B show schematic views of an alternate embodiment of the annular barrier tool of FIG. 10A.
Figure 11B:
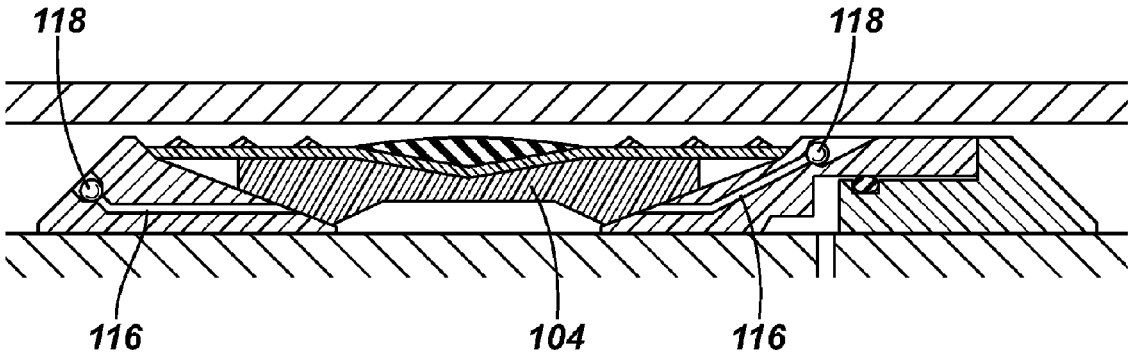

FIGS. 11A and 11B show an embodiment of ABT 12 in which fluid pressure is allowed to pass through a passageway 116 to bear on barrel support 104. In this embodiment, fluid pressure aids the actuation and maintenance of contact forces between wellbore wall 34 and seal 102 and slips 100. Passageway 116 may be located on either end of barrel support 104.

If one or more check valves 118 are used, passageways 116 may be on both sides of barrel support 104 such that fluid pressure from the higher pressure side will bear on barrel support 104.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. An annular barrier tool for use in a well comprising:

a mandrel; and a plurality of seal elements arranged on the mandrel, the plurality of seal elements comprising a first seal element mounted on the mandrel having an outer layer, a support beneath the outer layer, and end stops, at least one of the end stops being moveably carried on the mandrel, and in which the first seal element has a passageway to permit fluid pressure from an adjacent zone of the well to bear on an inner surface of the support to form a seal between the outer layer and one of a wellbore wall and a casing.

2. The annular barrier tool of claim 1 further comprising an inner layer beneath the support.

3. The annular barrier tool of claim 2 in which the either the inner and outer layers, or both, are conformable.

4. The annular barrier tool of claim 1 further comprising a mandrel seal near the end stop farthest from the passageway.

5. The annular barrier tool of claim 1 in which the support is joined to the end stops.

6. The annular barrier tool of claim 1 further comprising a ratchet mounted on the mandrel.

7. The annular barrier tool of claim 1, wherein the plurality of seal elements comprise a lower seal element and an upper seal element, and fluid from below the lower seal element passes into an upper seal element and fluid from above the upper seal element passes into the lower seal element.

8. The annular barrier tool of claim 1, wherein the plurality of seal elements comprise a lower seal element and an upper seal element, and fluid from below the lower seal element passes into the lower seal element and fluid from above an upper seal element passes into the upper seal element.

9. The annular barrier tool of claim 1, wherein the plurality of seal elements comprise a first seal element and a second seal element, and fluid from one side of the first seal element passes into the first seal element and fluid from that same side that leaks past the first seal element passes into the second seal element.

10. An annular barrier tool for use in a well comprising:

a mandrel;

a barrel support carried on the mandrel;

upper and lower cones carried on the mandrel on opposite sides of the barrel support, at least one of the cones being moveable relative to the mandrel; and a support sleeve at least partially surrounding the barrel support and joined to the cones, the support sleeve having slips and a seal thereon.

11. The annular barrier tool of claim 10 further comprising a port whereby fluid pressure passing through the port bears on the at least one moveable cone.

12. The annular barrier tool of claim 10 further comprising a ratchet to prevent motion of the moveable cone in a particular direction.

13. The annular barrier tool of claim 10 in which the at least one moveable cone is releasable from a set position.

14. The annular barrier tool of claim 10 further comprising a passageway in which fluid pressure passing through the passageway bears on the barrel support to force the barrel support radially outward.

15. The annular barrier tool of claim 10 further comprising an upper passageway and a lower passageway, each passageway having a one-way valve therein, and in which fluid pressure passing through either passageway bears on the barrel support to force the barrel support radially outward.

16. A method to block or restrict flow in a well annulus comprising:

stacking a plurality of seal elements, comprising stacking a first seal element comprising an elastic support and a conformable seal disposed between two end caps;

placing an annular barrier tool having the first seal element a seal element in a desired location of the well; and forming a seal between the conformable seal and one of a wellbore wall and a casing, the forming comprising forcing relative motion between the end caps to cause the elastic support and the conformable seal to move radially outward to engage said one of the wellbore wall and the casing.

17. The method of claim 16 in which the forcing act includes applying fluid pressure on at least one of the end caps.

18. The method of claim 16 further comprising applying fluid pressure to the elastic support to energize the seal element.

19. The method of claim 16, wherein the plurality of seal elements comprise a lower seal element and an upper seal element, the method further comprising passing fluid from below the lower seal element into an upper seal element and passing fluid from above the upper seal element into the lower seal element.

20. The method of claim 16, wherein the plurality of seal elements comprise a lower seal element and an upper seal element, the method further comprising passing fluid from below the lower seal element into the lower seal element and passing fluid from above the upper seal element into the upper seal element.

21. The method of claim 16, wherein the plurality of seal elements comprise a first seal element and a second seal element, the method further comprising passing fluid from one side of the first seal element into the first seal element and passing fluid from that same side that leaks past the first seal element into the second seal element.

22. The method of claim 16 further comprising allowing relative separation between the end caps to allow the elastic support and conformable seal to disengage from the wellbore wall.

23. A method to block or restrict flow in a well annulus comprising:

placing in a desired location of the well an annular barrier tool having a seal element comprising a barrel support and an elastic support having slips and a seal thereon, the seal element being disposed between two cones; and forcing relative motion between the cones to cause the barrel support and elastic support to move radially outward such that the slips and seal engage the wellbore wall.

24. The method of claim 23 in which the forcing step includes applying fluid pressure on at least one of the cones.

25. The method of claim 23 further comprising applying fluid pressure to the barrel support to energize the seal element.

26. The method of claim 23 further comprising stacking a plurality of seal elements.

27. The method of claim 26 further comprising passing fluid from below a lower seal element into an upper seal element and passing fluid from above the upper seal element into the lower seal element.

28. The method of claim 26 further comprising passing fluid from below a lower seal element into the lower seal element and passing fluid from above an upper seal element into the upper seal element.

29. The method of claim 26 further comprising passing fluid from one side of a first seal element into the first seal element and passing fluid from that same side that leaks past the first seal element into a second seal element.

30. The method of claim 23 further comprising allowing relative separation between the cones to allow the slips and seal to disengage from the wellbore wall.

31. The method of claim 16, further comprising:

communicating fluid from an adjacent zone of the well inside the conformable seal to exert a force against the conformable seal to move the conformable seal radially outward to engage said one of the wellbore wall and the casing.

* * * * *